US010139145B2

(12) United States Patent
DuPlessis et al.

(10) Patent No.: US 10,139,145 B2
(45) Date of Patent: Nov. 27, 2018

(54) FILTERS FOR STAND-ALONE ICE MAKING APPLIANCES

(71) Applicant: General Electric Company, Schenectady, NY (US)

(72) Inventors: Samuel Vincent DuPlessis, Louisville, KY (US); Timothy Scott Shaffer, La Grange, KY (US); Ronald Scott Tarr, Louisville, KY (US); Tomas Garces, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 42 days.

(21) Appl. No.: 15/084,532

(22) Filed: Mar. 30, 2016

(65) Prior Publication Data

US 2017/0284721 A1 Oct. 5, 2017

(51) Int. Cl.

| | |
|---|---|
| ***F25C 1/25*** | (2018.01) |
| ***F25C 1/147*** | (2018.01) |
| ***F25C 5/182*** | (2018.01) |
| ***F25D 11/00*** | (2006.01) |

(52) U.S. Cl.

CPC ..... *F25C 1/25* (2018.01); *F25C 1/147* (2013.01); *F25C 5/182* (2013.01); *F25D 11/00* (2013.01); *F25C 2400/12* (2013.01); *F25C 2400/14* (2013.01); *F25D 2323/121* (2013.01)

(58) Field of Classification Search

CPC .. F25C 1/225; F25C 1/147; F25C 1/14; F25C 5/182; F25C 2400/12; F25C 2400/14; F25D 11/00; F25D 2323/121

USPC ..... 62/319, 340, 449

See application file for complete search history.

(56) References Cited

U.S. PATENT DOCUMENTS

| | | | | |
|---|---|---|---|---|
| 9,134,060 | B2 | 9/2015 | Seymour | |
| 2009/0145158 | A1* | 6/2009 | Anselmino | F25C 5/22 62/344 |
| 2009/0165491 | A1* | 7/2009 | Rafalovich | F25C 1/04 62/344 |
| 2009/0165492 | A1* | 7/2009 | Wilson | F25C 1/10 62/344 |
| 2010/0147008 | A1* | 6/2010 | Watson | F25C 5/005 62/340 |
| 2013/0205820 | A1* | 8/2013 | Wong | A47F 3/0469 62/246 |
| 2014/0202195 | A1 | 6/2014 | Hawkins et al. | |

FOREIGN PATENT DOCUMENTS

KR 20140123283 A 10/2014

* cited by examiner

*Primary Examiner* — Melvin Jones
(74) *Attorney, Agent, or Firm* — Dority & Manning, P.A.

(57) ABSTRACT

Stand-alone ice making appliances are provided. An appliance includes a container defining a first storage volume for receipt of ice, a water tank defining a second storage volume for receipt of water, and a pump in fluid communication with the second storage volume. The appliance further includes an ice maker which is in fluid communication with the pump for receiving water from the pump. The appliance further includes a filter, the filter including a filter medium operable to remove contaminants from water flowing through the filter medium, the filter positioned upstream of the ice maker in a flow direction of water from the second storage volume to the ice maker.

18 Claims, 10 Drawing Sheets

FILTERS FOR STAND-ALONE ICE MAKING APPLIANCES

FIELD OF THE INVENTION

The present subject matter relates generally to stand-alone ice making appliances, and in exemplary embodiments to stand-alone ice making appliances which produce nugget ice and which utilize filters for contaminate removal.

BACKGROUND OF THE INVENTION

Ice makers generally produce ice for the use of consumers, such as in drinks being consumed, for cooling foods or drinks to be consumed and/or for other various purposes. Certain refrigerator appliances include ice makers for producing ice. The ice maker can be positioned within the appliances' freezer chamber and direct ice into an ice bucket where it can be stored within the freezer chamber. Such refrigerator appliances can also include a dispensing system for assisting a user with accessing ice produced by the refrigerator appliances' ice maker. However, the incorporation of ice makers into refrigerator appliance can have drawbacks, such as limits on the amount of ice that can be produced and the reliance on the refrigeration system of the refrigerator appliance to form the ice.

Recently, stand-alone ice makers have been developed. These ice makers are separate from refrigerator appliances and provide independent ice supplies. However, many stand-alone ice makers require a connection to the plumbing of the dwelling where the ice maker resides, in order to have access to a water supply. Additionally, many stand-alone ice makers do not allow for removal of the ice bucket, instead requiring that ice be scooped from the bucket for use. Further, typical stand-alone ice makers are expensive, to the point of being cost-prohibitive to the typical consumer. Still further, filtering of water that is provided (i.e. by a user) to such stand-alone ice makers is desired.

Accordingly, improved stand-alone ice makers are desired in the art. In particular, cost-effective stand-alone ice makers which address various of the above issues would be advantageous.

BRIEF DESCRIPTION OF THE INVENTION

Aspects and advantages of the invention will be set forth in part in the following description, or may be apparent from the description, or may be learned through practice of the invention.

In accordance with one embodiment, a stand-alone ice making appliance is provided. The appliance includes a container defining a first storage volume for receipt of ice, a water tank, the water tank defining a second storage volume for receipt of water, and a pump in fluid communication with the second storage volume for actively flowing water from the water tank. The appliance further includes an ice maker, the ice maker in fluid communication with the pump for receiving water from the pump. The appliance further includes a filter, the filter including a filter medium operable to remove contaminants from water flowing through the filter medium, the filter positioned upstream of the ice maker in a flow direction of water from the second storage volume to the ice maker.

In accordance with another embodiment, a stand-alone ice making appliance is provided. The appliance includes a removable container defining a first storage volume for receipt of ice, a water tank, the water tank defining a second storage volume for receipt of water and disposed below the container along a vertical direction, and a pump in fluid communication with the second storage volume for actively flowing water from the water tank. The appliance further includes a reservoir defining a third storage volume, the third storage volume in fluid communication with the pump for receiving water that is actively flowed from the water tank. The appliance further includes an ice maker, the ice maker including a sealed refrigeration system. The appliance further includes a chute extending between the ice maker and the container for directing ice produced by the ice maker towards the first storage volume. The appliance further includes a filter disposed within the second storage volume, the filter including a filter medium operable to remove contaminants from water flowing through the filter medium, wherein water is flowable from the second storage volume through the filter to the pump. Ice within the first storage volume is maintained at a temperature greater than thirty-two degrees Fahrenheit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
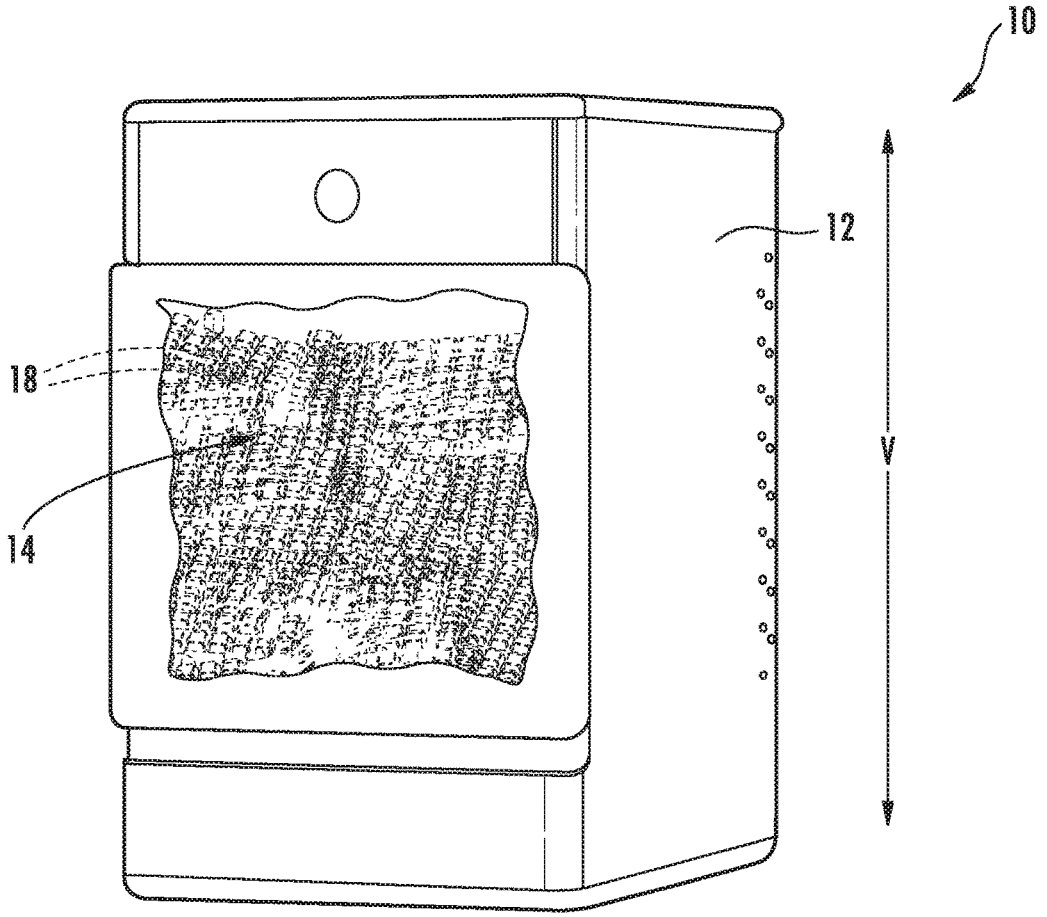
FIG. 1 is a perspective view of a stand-alone ice making appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
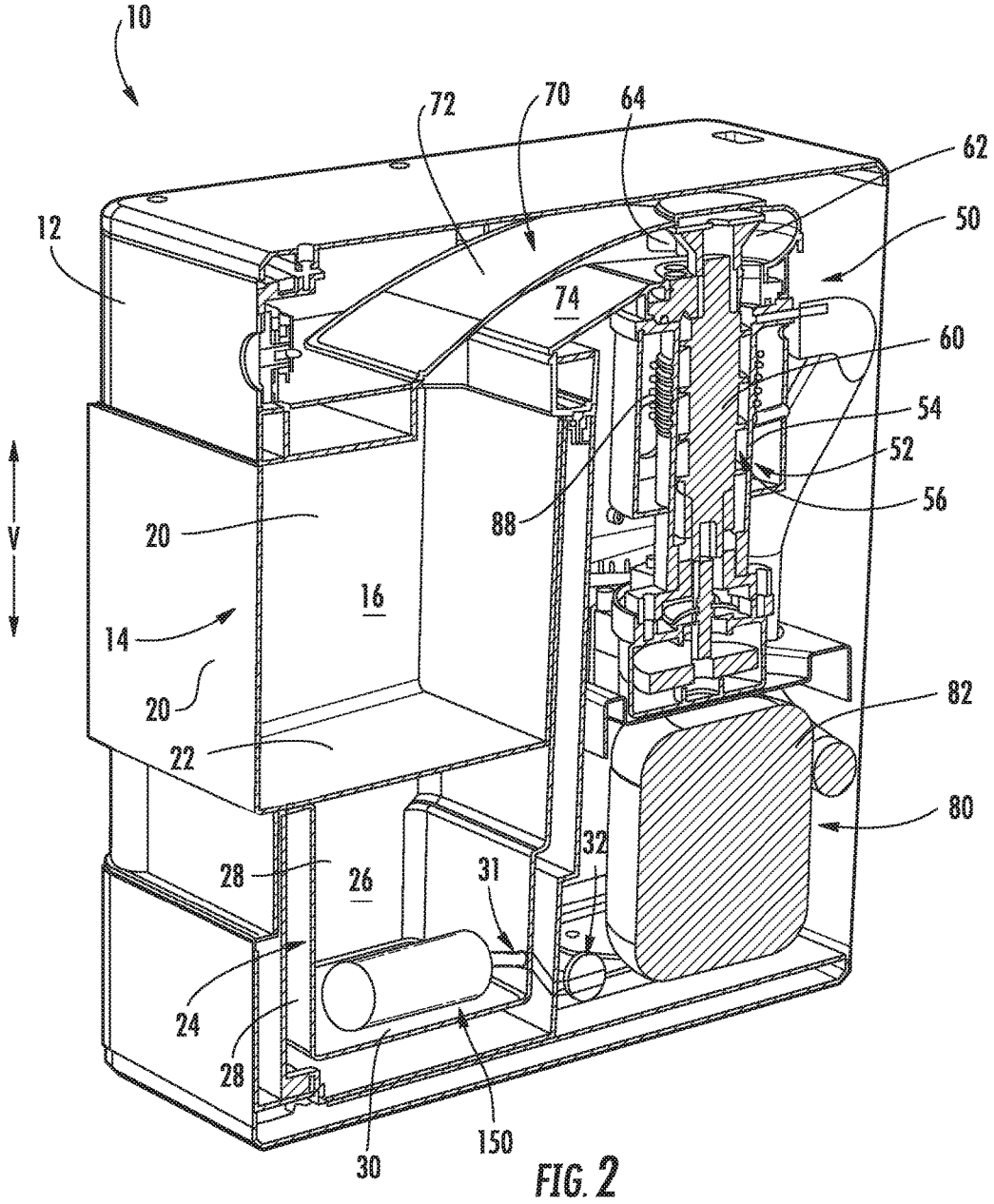
FIG. 2 is a perspective sectional view of a stand-alone ice making appliance in accordance with one embodiment of the present disclosure.
Figure 3:
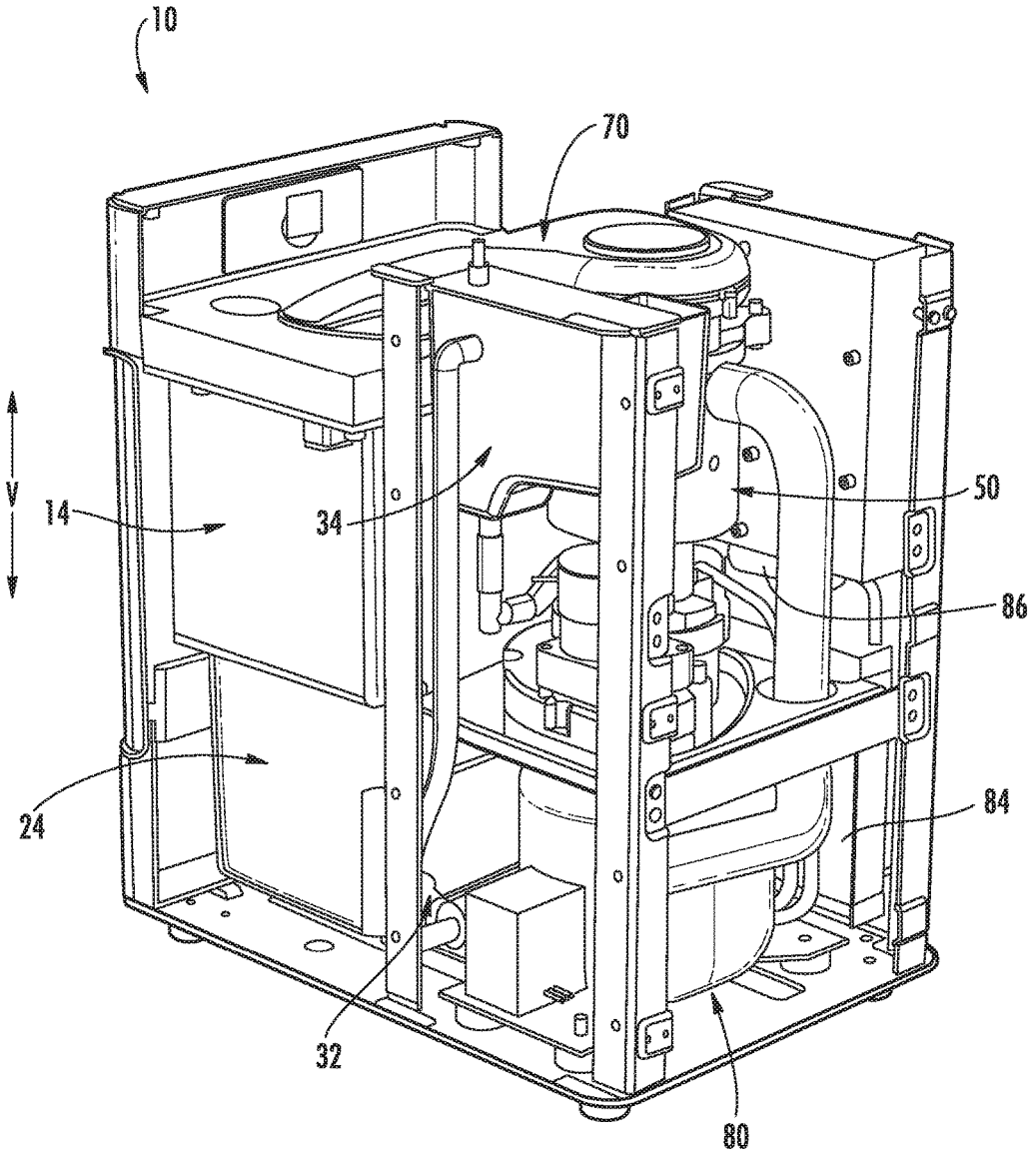
FIG. 3 is a rear perspective view (with a casing removed) of a stand-alone ice making appliance in accordance with one embodiment of the present disclosure.
Figure 4:
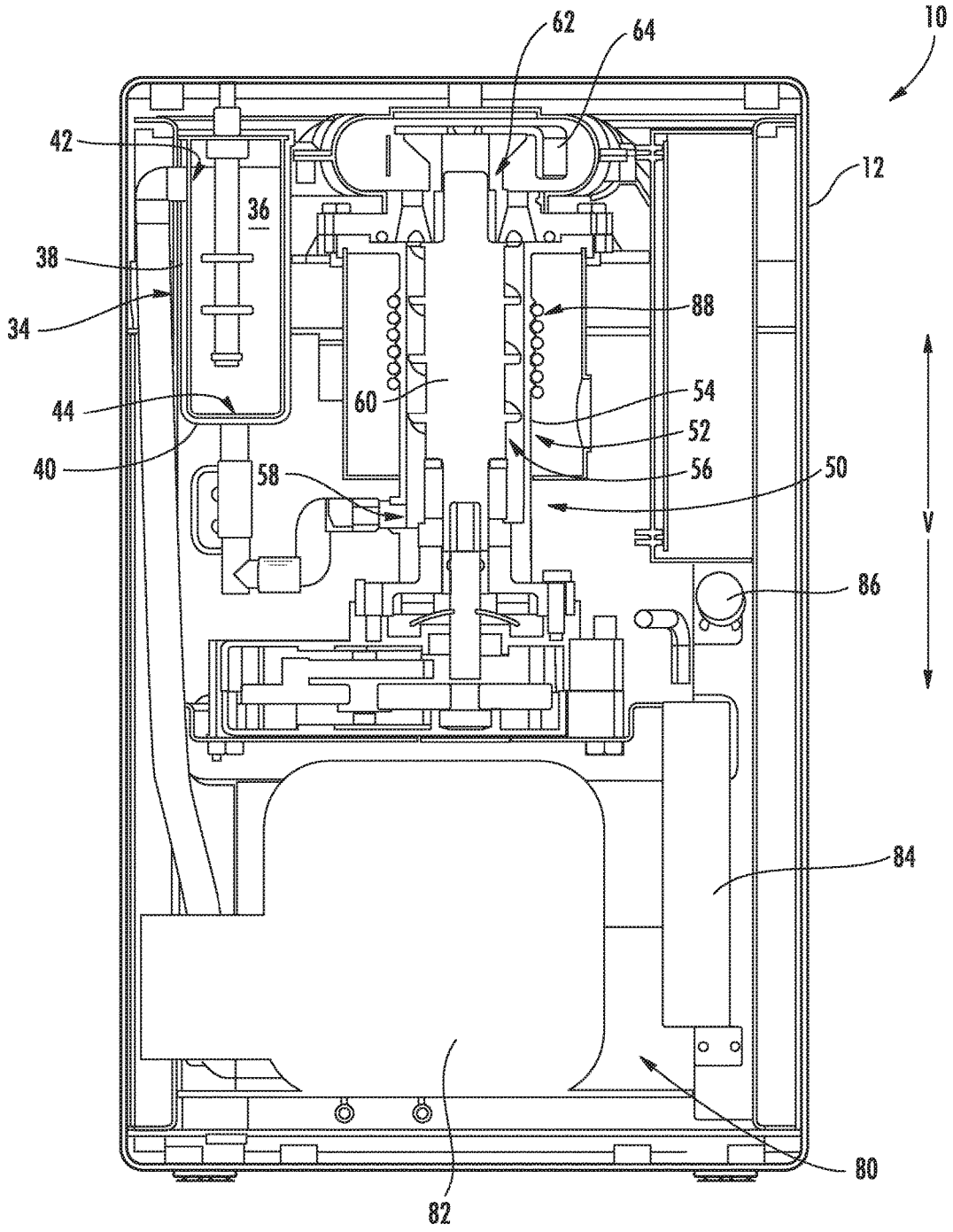
FIG. 4 is a rear sectional view of a stand-alone ice making appliance in accordance with one embodiment of the present disclosure.

Referring now to FIG. 1, one embodiment of a stand-alone ice making appliance 10 in accordance with the present disclosure is illustrated. As shown, appliance 10 includes an outer casing 12 which generally at least partially houses various other components of the appliance therein 10. A container 14 is also illustrated. Container 14 defines a first storage volume 16 for the receipt and storage of ice 18 therein. A user of the appliance 10 may access ice 18 within the container 14 for consumption or other uses. Container 14 may include one or more sidewalls 20 and a base wall 22 (see FIG. 2), which may together define the first storage volume 16. In exemplary embodiments, at least one sidewall 20 may be formed from a clear, see-through (i.e. transparent or translucent) material, such as a clear glass or plastic, such that a user can see into the first storage volume 16 and thus view ice 18 therein. Further, in exemplary embodiments, container 14 may be removable, such as from the outer casing 12, by a user. This facilitates easy access by the user to ice within the container 14 and further, for example, may provide access to a water tank 24 (see FIG. 2) of the appliance 10.

Appliances 10 in accordance with the present disclosure are advantageously stand-alone appliances, and thus are not connected to refrigerators or other appliances. Additionally, in exemplary embodiments, such appliances are non-plumbed, and thus not connected to plumbing or another water source that is external to the appliance 10, such as a refrigerator water source. Rather, in exemplary embodiments, water is initially supplied to the appliance 10 manually by a user, such as by pouring water into water tank 24.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. The removable container 14 allows easy access to ice and allows the container 14 to be moved to a different position from the remainder of the appliance 10 for ice usage purposes. Additionally, in exemplary embodiments as discussed herein, appliance 10 is configured to make nugget ice (as discussed herein) which is becoming increasingly popular with consumers.

Referring to FIGS. 2 through 5, various other components of appliances 10 in accordance with the present disclosure are illustrated. For example, as mentioned, appliance 10 includes a water tank 24. The water tank 24 defines a second storage volume 26 for the receipt and holding of water. Water tank 24 may include one or more sidewalls 28 and a base wall 30 which may together define the second storage volume 26. In exemplary embodiments, the water tank 24 may be disposed below the container 14 along a vertical direction V defined for the appliance 10, as shown.

As discussed, in exemplary embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through an opening 31 defined in the water tank 24, such as in a sidewall 28 thereof, and may flow through a conduit to and through pump 32. Pump 32 may, when activated, actively flow water from the second storage volume 26 therethrough and from the pump 32.

Water actively flowed from the pump 32 may be flowed (for example through a suitable conduit) to ice maker 50. For example, in some embodiments water actively flowed from the pump 32 may be flowed (for example through a suitable conduit) directly to the ice maker 50. Alternatively, an intermediate reservoir 34 may be provided, and water may be actively flowed from the pump 32 to the reservoir 34. For example, reservoir 34 may define a third storage volume 36, which may be defined by one or more sidewalls 38 and a base wall 40. Third storage volume 36 may, for example, be in fluid communication with the pump 32 and may thus receive water that is actively flowed from the water tank 24, such as through the pump 32. For example, water may be flowed into the third storage volume 36 through an opening 42 defined in the reservoir 34.

Reservoir 34 and third storage volume 36 thereof may receive and contain water to be provided to an ice maker 50 for the production of ice. Accordingly, third storage volume 36 may be in fluid communication with ice maker 50. For example, water may be flowed, such as through opening 44 and through suitable conduits, from third storage volume 36 to ice maker 50.

Ice maker 50 generally receives water, such as from reservoir, and freezes the water to form ice 18. The ice maker 50 is in fluid communication with the pump 32, such as directly or indirectly via reservoir 34 and third storage volume 36. While any suitable style of ice maker is within the scope and spirit of the present disclosure, in exemplary embodiments, ice maker 50 is a nugget ice maker, and in particular is an auger-style ice maker. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening 58 may be defined in a sidewall 54. Water may be flowed from third storage volume 36 through the opening 58 (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in exemplary embodiments, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provide to the container 14. In exemplary embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72 which defines a passage 74 therethrough. Ice 18 may be directed from the ice maker 50 (such as from the auger 60 and/or extruder 62) through the passage 74 to the container 14. In some embodiments, for example, a sweep 64, which may for example be connected to and rotate with the auger, may contact the ice emerging through the extruder 62 from the auger 60 and direct the ice through the passage 74 to the container 14.

As discussed, water within the casing 52 may at least partially freeze due to heat exchange, such as with a refrigeration system. In exemplary embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86 and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof. During operation of sealed system 80, refrigerant exits evaporator 88 as a fluid in the form of a superheated vapor and/or vapor mixture. Upon exiting evaporator 88, the refrigerant enters compressor 82 wherein the pressure and temperature of the refrigerant are increased such that the refrigerant becomes a superheated vapor. The superheated vapor from compressor 82 enters condenser 84 wherein energy is transferred therefrom and condenses into a saturated liquid and/or liquid vapor mixture. This fluid exits condenser 84 and travels through throttling device 86 that is configured for regulating a flow rate of refrigerant therethrough. Upon exiting throttling device 86, the pressure and temperature of the refrigerant drop at which time the refrigerant enters evaporator 88 and the cycle repeats itself In certain exemplary embodiments, as illustrated in FIGS. 5 through 6, throttling device 86 may be a capillary tube.

As discussed, in exemplary embodiments, ice 18 may be nugget ice. Nugget ice is ice that that is maintained or stored (i.e. in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than 60 degrees Fahrenheit.

Ice 18 held within the first storage volume 16 may gradually melt. The melting speed is increased for nugget ice due to the increased maintenance/storage temperature. Accordingly, drain features may advantageously be provided in the container for draining such melt water. Additionally, and advantageously, the melt water may in exemplary embodiments be reused by appliance 10 to form ice.

Figure 5:
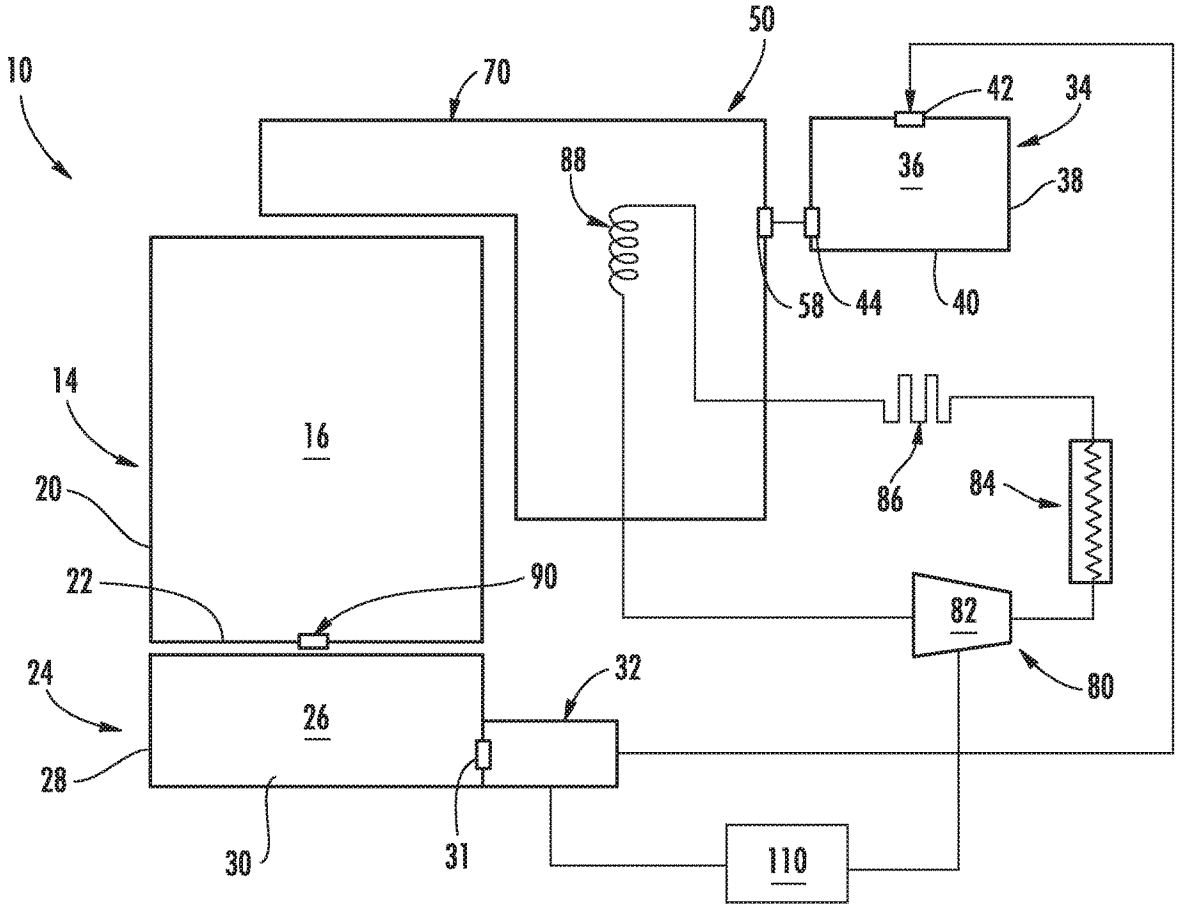
FIG. 5 is a schematic diagram of a stand-alone ice making appliance in accordance with one embodiment of the present disclosure.
Figure 6:
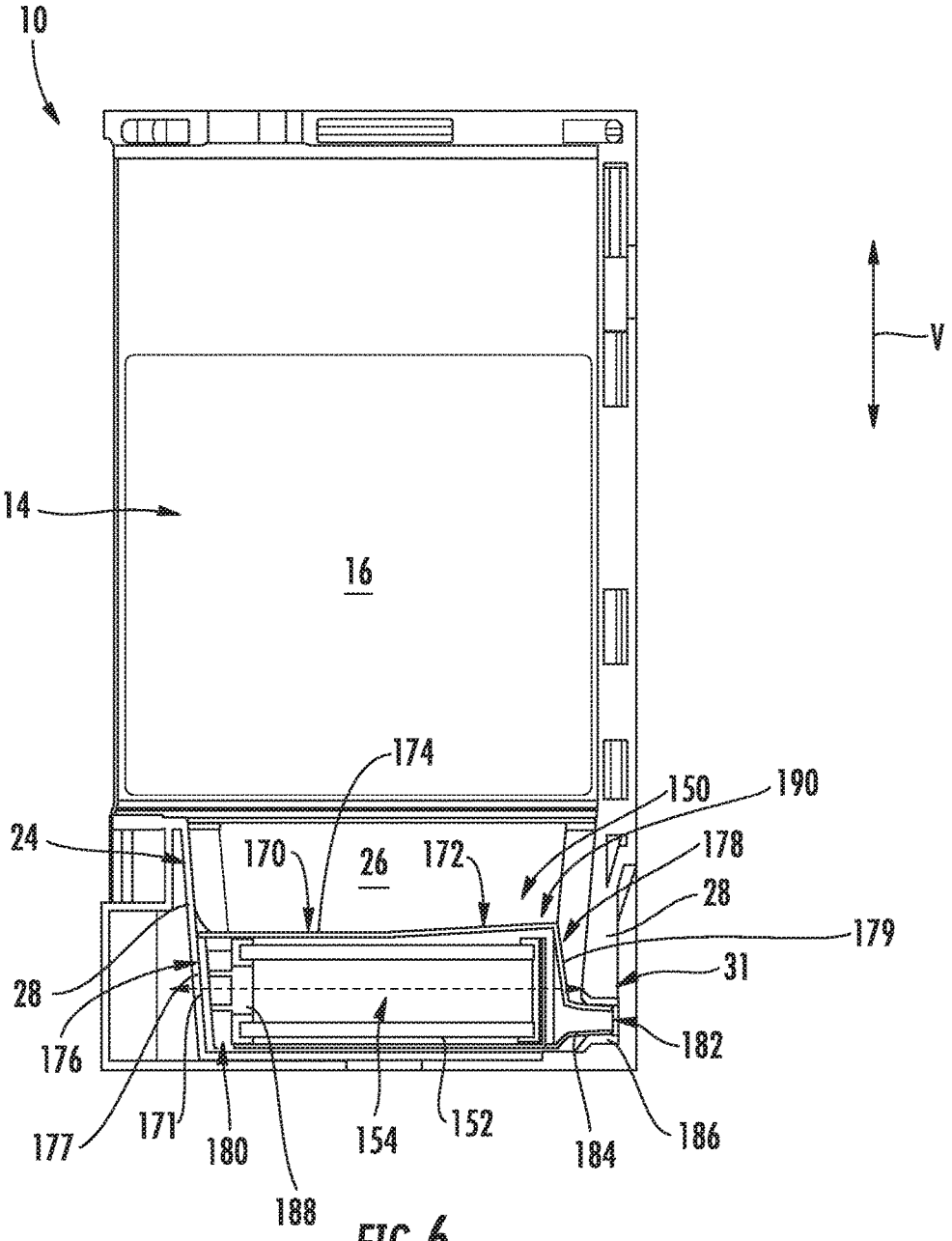
FIG. 6 is a side cross-sectional view of a portion of a stand-alone ice making appliance in accordance with one embodiment of the present disclosure.

For example, in some embodiments as illustrated in FIG. 5, a drain aperture 90 may be defined in the base wall 22. Drain aperture 90 may allow water to flow from the first storage volume 16 and container 14 generally. Further, in exemplary embodiments, water flowing from the first storage volume 16 and container 14 may, due to gravity and the vertical alignment of the container 14 of water tank 24, flow into the second storage volume 26.

In exemplary embodiments, appliance 10 may further include a controller 110. Controller 110 may for example, be configured to operate the appliance 10 based on, for example, user inputs to the appliance 10 (such as to a user interface thereof), inputs from various sensors disposed within the appliance 10, and/or other suitable inputs. Controller 110 may for example include one or more memory devices and one or more microprocessors, such as general or special purpose microprocessors operable to execute programming instructions or micro-control code associated with appliance 10 operation. The memory may represent random access memory such as DRAM, or read only memory such as ROM or FLASH. In one embodiment, the processor executes programming instructions stored in memory. The memory may be a separate component from the processor or may be included onboard within the processor.

In exemplary embodiments, controller 110 may be in operative communication with the pump 32. Such operative communication may be via a wired or wireless connection, and may facilitate the transmittal and/or receipt of signals by the controller 110 and pump 32. Controller 110 may be configured to activate the pump 32 to actively flow water. For example, controller 110 may activate the pump 32 to actively flow water therethrough when, for example, reservoir 34 requires water. A suitable sensor(s), for example, may be provided in the third storage volume 36. The sensor(s) may be in operative communication with the controller 110 may be transmit signals to the controller 110 which indicate whether or not additional water is desired in the reservoir 34. When controller 110 receives a signal that water is desired, controller 110 may send a signal to pump 32 to activate that pump.

It should additionally be noted that, in exemplary embodiments, controller 110 may be in operative communication with the sealed system 80, such as with the compressor 82 thereof, and may activate the sealed system 80 as desired or required for ice making purposes.

Referring now to FIGS. 6 through 10, in exemplary embodiments as shown, a filter 150 may be provided. In general, the filter 150 may be positioned upstream of the ice maker 50 in a flow direction of water from the second storage volume 26 to the ice maker 50. For example, in exemplary embodiments as shown, the filter 150 may be disposed within the second storage volume 26 for filtering water that is provided in the second storage volume 26, such as before the water is flowed from the second storage volume 26 for ice formation purposes. Accordingly, water within the second storage volume 26 may flow through filter 150, and from filter 150 to downstream components of the appliance 10 such as pump 32. Alternatively, however, the filter 150 may be positioned downstream of the pump 32, such as between the pump 32 and ice maker 50, and may for example be in line between the pump 32 and ice maker 50, in the third storage volume 36, etc.

Specifically, filter 150 may include a filter medium 152 which is operable to remove contaminants from water flowing through the filter medium 152. Contaminants may include but are not limited to dirt, sediment, sand, rust, lead, cysts and other debris which may be mechanically filtered from the water, as well as volatile organic compounds such as chloroform, lindane, and atrazine which can be adsorbed into pore surfaces in the filter medium 152. Any suitable filter medium 152 may be utilized, including for example, activated carbon blocks, pleated polymer sheets, spun cord materials, or melt blown materials. In exemplary embodiments, a filter medium 152 may include a bacteriostatic agent such as silver.

In some embodiments, as illustrated, the filter medium 152 may form a partition, such as within the second storage volume 26 as shown, segmenting the second storage volume 26 into a pre-filtered portion 160 and a post-filtered portion 162. The post-filtered portion 162 may include the opening 31. In these embodiments, the filter 150 may for example only include the filter medium 152, or may additionally include other components such as a frame or body in which the filter medium 152 is disposed.

Figure 9:
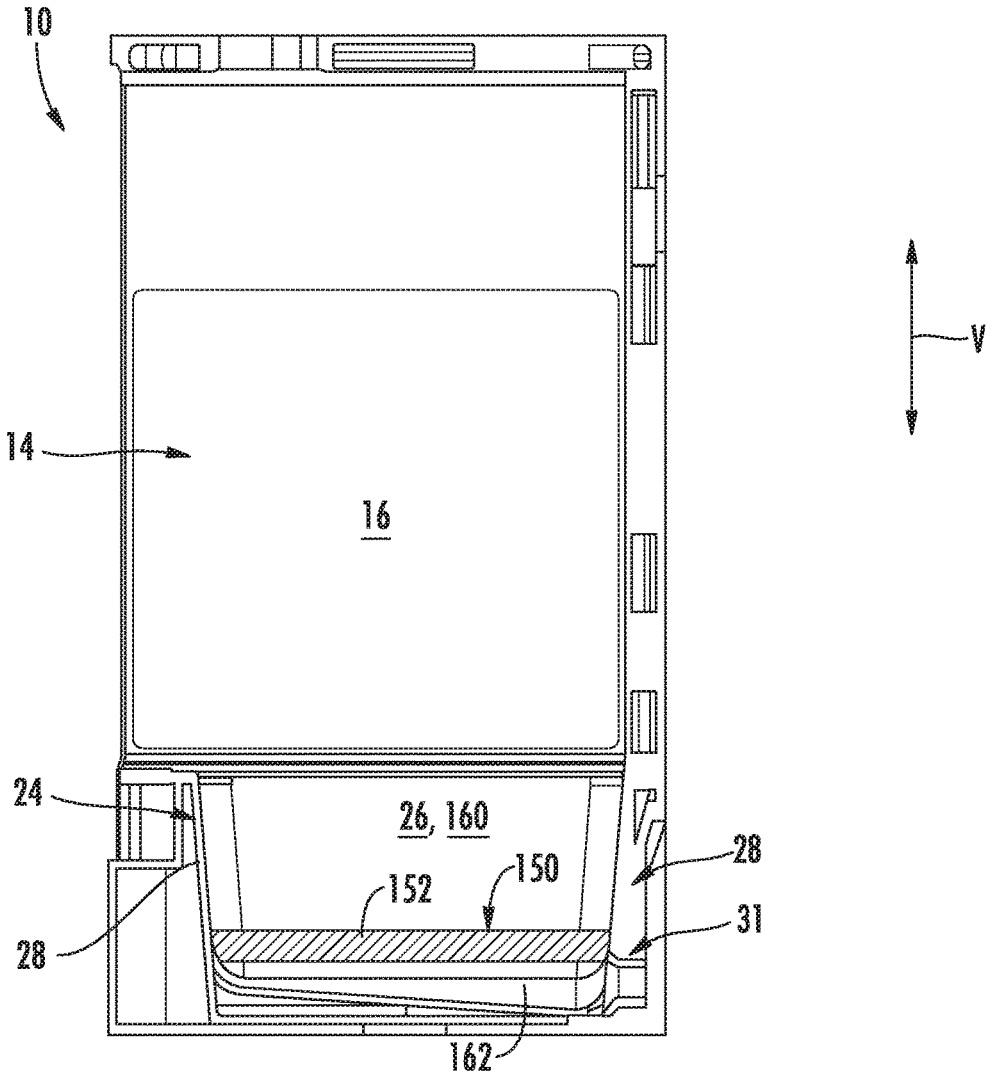
FIG. 9 is a side cross-sectional view of a portion of a stand-alone ice making appliance in accordance with another embodiment of the present disclosure.
Figure 10:
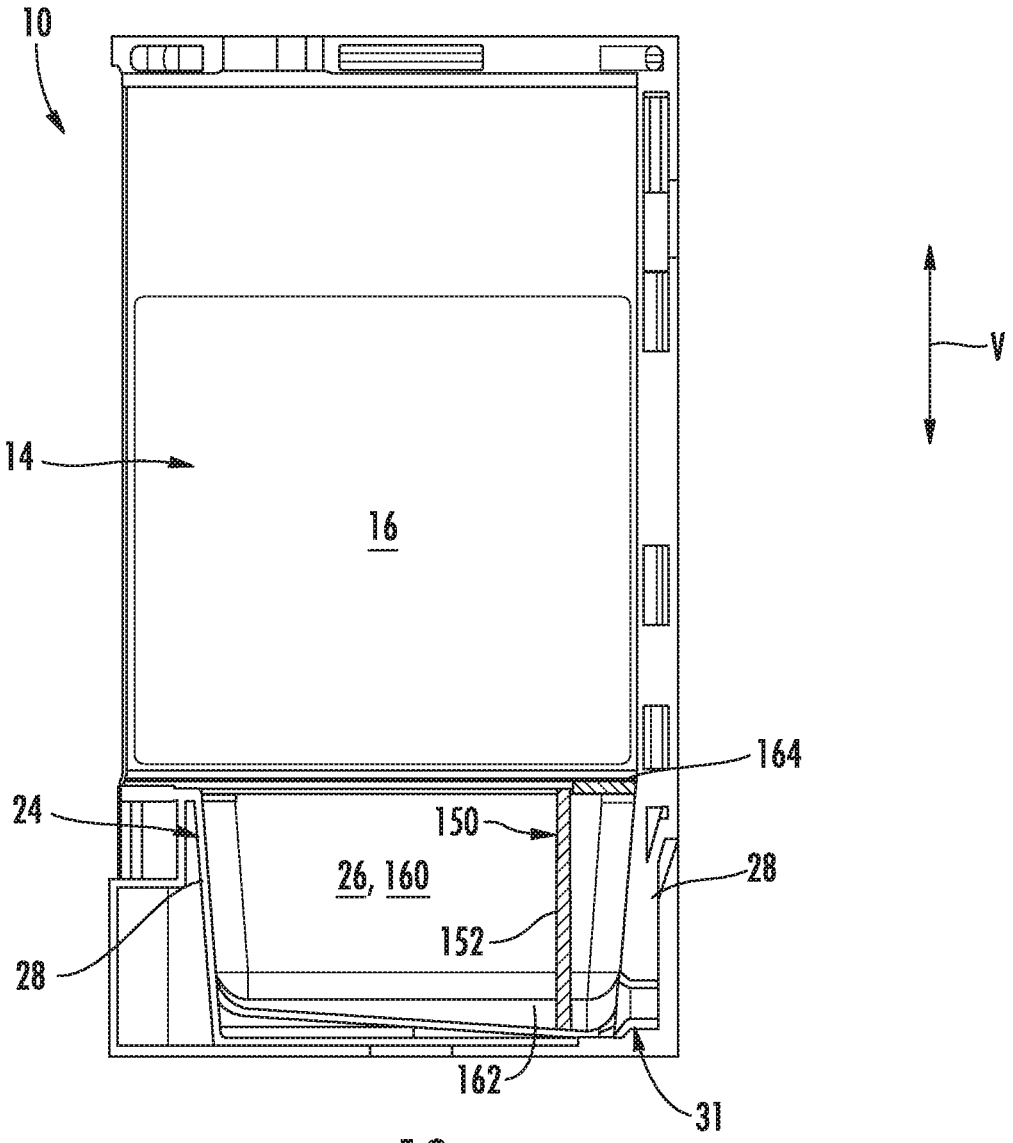
FIG. 10 is a side cross-sectional view of a portion of a stand-alone ice making appliance in accordance with another embodiment of the present disclosure.

In some embodiments, as illustrated in FIG. 9, the filter medium 152 may be generally horizontally extending, such that the pre-filtered portion 160 is above the post-filtered portion 162 along the vertical direction V. In alternative embodiments, as illustrated in FIG. 10, the filter medium 152 may be generally vertically extending, such that the pre-filtered portion 160 and post-filtered portion 162 are side-by-side along the vertical direction V. In further alternative embodiments, the filter medium 152 may extend at any suitable angle between vertical and horizontal to partition a volume such as the second storage volume 26.

Notably, in some embodiments (such as when the filter medium 152 is generally vertically extending), a cap 164 may be provided, such as adjacent a top of the water tank 24 along the vertical direction V, to prevent access to the post-filtered portion 162 by, for example, a user pouring water into the volume such as the second storage volume 26. This prevents contamination of filtered water within the post-filtered portion 162.

Figure 7:
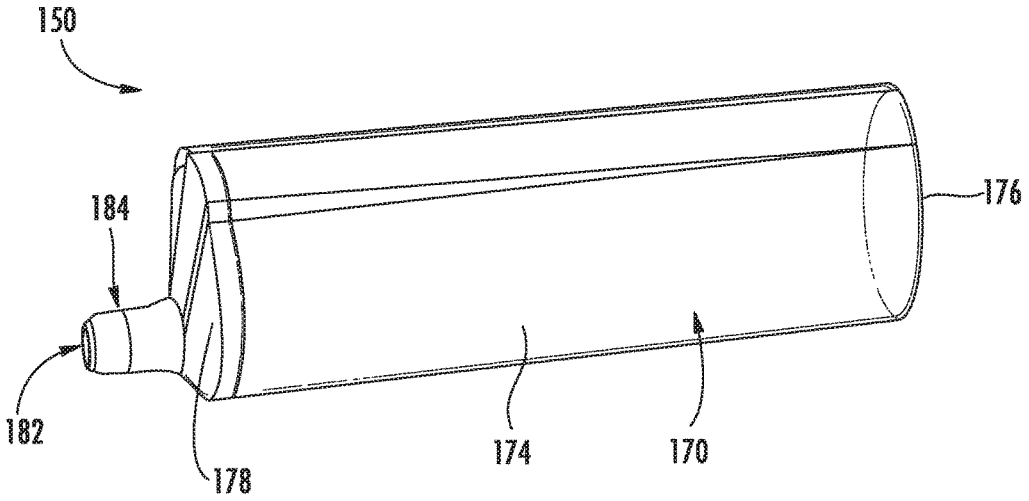
FIG. 7 is a perspective view of a filter for use in a stand-alone ice making appliance in accordance with one embodiment of the present disclosure.
Figure 8:
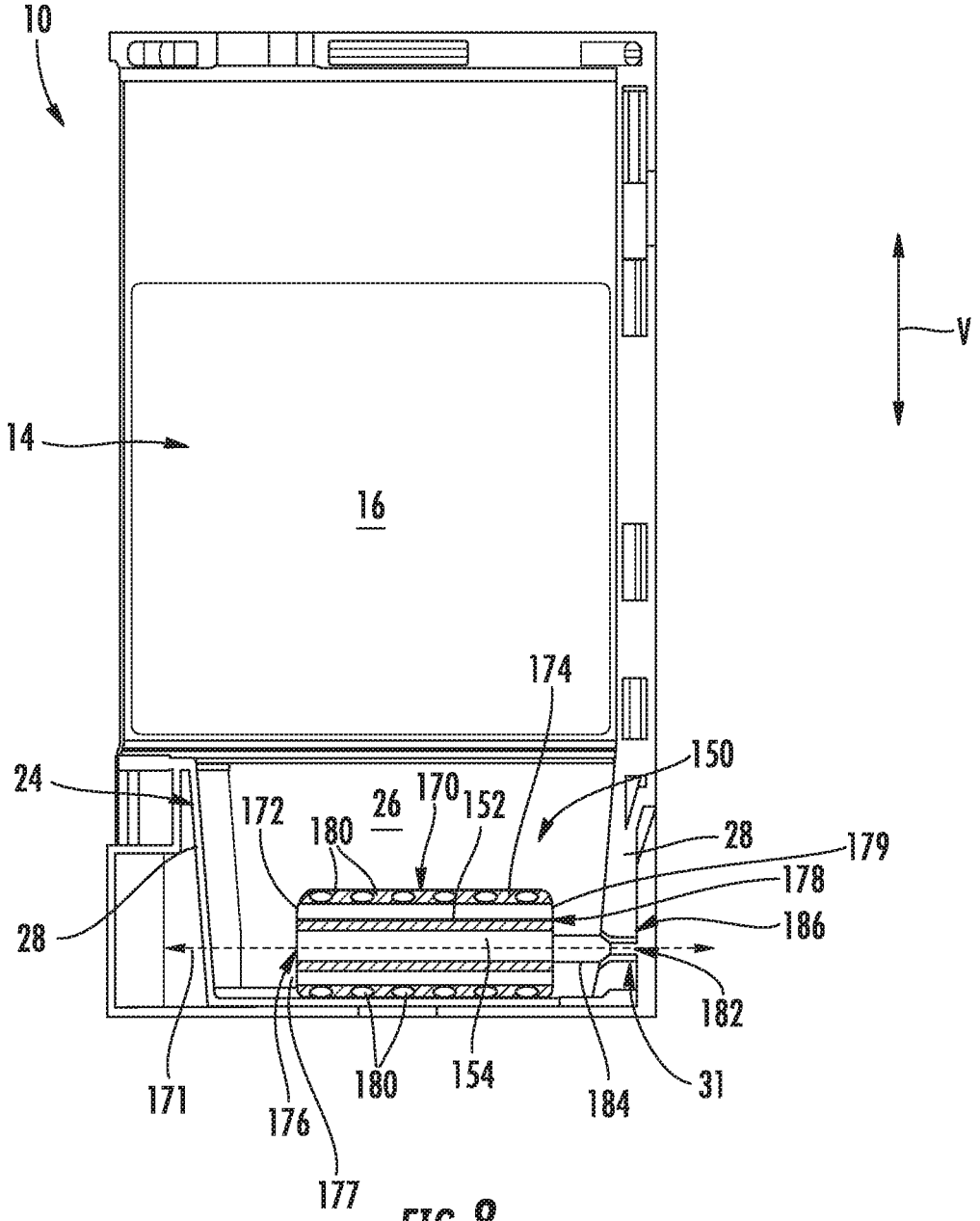
FIG. 8 is a side cross-sectional view of a portion of a stand-alone ice making appliance in accordance with another embodiment of the present disclosure.

Referring now to FIGS. 6 through 8, in alternative embodiments, filter 150 may include a body 170 which generally houses the filter medium 152. Accordingly, filter medium 152 in these embodiments is disposed within an interior 172 of the body 170. Further, in exemplary embodiments, filter medium 152 may for example have a hollow cylindrical shape which defines an interior 154. As discussed herein, in some embodiments, water may be filtered via a flow path from interior 172 through filter medium 152 into interior 154, or via a flow path from interior 154 through filter medium 152 into interior 172.

Body 170 may, for example, include a sidewall 174 which extends along a longitudinal axis 171 between a first end wall 176 and a second end wall 178. The sidewall 174 may, for example, have a hollow cylindrical shape. One or more inlets 180 and one or more outlets 182 may be defined in the body 170. Unfiltered water may flow into the body 170 through the inlets 180, and filtered water may flow from the body 170 through outlets 182.

In some embodiments, as illustrated in FIGS. 6 and 7, an inlet 180 may be defined proximate the first end wall 176 relative to the second end wall 178 along the longitudinal axis 171 (i.e. closer to the first end wall 176 than the second end wall 178 along the longitudinal axis 171).

The inlet 180, for example, may be defined in the sidewall 174 and contiguous with the first end wall 176, as shown. Notably, the inlet 180 may only extend about a portion of the periphery of sidewall 174 and thus may not be an entirely peripheral or circumferential inlet. This facilitates correct orientation of the filter 150, as the inlet 180 is desirably located at a bottom of the filter 150 along the vertical direction V when the filter 150 is correctly disposed within a volume such as the second storage volume 26. In alternative embodiments, the inlet 180 may be defined in the first end wall 176, and may for example be contiguous with the sidewall 174. Notably, the inlet 180 in these embodiments may be offset along an outer surface 177 of the first end wall 176 from a centroid of the outer surface 177, thus facilitating correct orientation of the filter 150. For example, the inlet 180 may be disposed at or adjacent to the periphery of the first end wall 176 (and may for example, only extend about a portion of this periphery).

In alternative embodiments, as illustrated in FIG. 8, a plurality of inlets 180 may be defined in the sidewall 174. In these embodiments, inlets 180 may for example be peripherally and/or longitudinally spaced apart to define one or more peripheral and/or longitudinal arrays, as shown.

Referring again to FIGS. 6 through 8, an outlet may be defined proximate the second end wall 178 relative to the first end wall 176 along the longitudinal axis 171 (i.e. closer to the second end wall 178 than the first end wall 176 along the longitudinal axis 171). For example, in exemplary embodiments as illustrated, a body 170 may include a nozzle 184 which protrudes (i.e. away from interior 172) from the second wall 178 along the longitudinal axis 171. The nozzle 184 (through which water may flow) may define the outlet 182, as shown.

In some embodiments, as illustrated in FIGS. 6 and 7, the nozzle 184 (and thus the outlet 182) may be offset along an outer surface 179 of the second end wall 178 from a centroid of the outer surface 179, thus facilitating correct orientation of the filter 150. Alternatively, as illustrated in FIG. 8, the nozzle 184 (and thus the outlet 182) may be aligned with the centroid of the outer surface 179.

Referring again to FIGS. 6 through 8, water may flow from the second storage volume 26 and the filter 150 through an opening 31 in the water tank 24. In exemplary embodiments, a female fitting 186 may be disposed within the opening 31. Female fitting 186 may facilitate a connection between the filter 150 and a downstream conduit (which for example is a component of or leads to the pump 32). When connected, the nozzle 184 may extend into the female fitting 186, as shown.

As mentioned, water may flow on a particular flow path through filter 150 and filter medium 152 thereof to be filtered before being exhausted through outlet 182. For example, in some embodiments, as illustrated in FIG. 6, a flow path may be defined through an inlet 180 into the interior 154, from the interior 154 through the filter medium 152 into the interior 172, and from the interior 172 to the outlet 182. For example, a seal ring 188 may be disposed in the interior 172. The seal ring 188 may be connected to the filter medium 152, i.e. to an end thereof, and may provide a partition to separate filtered and unfiltered water in the interior 172. Water may flow through the inlet 180 into the interior 172 (i.e. in an unfiltered portion thereof), and in the interior 172 may flow through the seal ring 188 into the interior 154. The water may then flow from the interior 154 through the filter medium 152 to the interior 172 (i.e. a filter portion thereof), and from interior 172 through nozzle 184 and outlet 182. Notably, sidewall 174 in exemplary embodiments may include a protrusion 190 which extends outwardly away from the interior 172. The protrusion 190 may extend the entire length of the sidewall 174 along the longitudinal axis 171 or only along a portion of the length, and may extend through only a portion of the periphery of the sidewall 174. The protrusion 190 may provide extra room in the interior 172 for water flowed through the filter medium 152 to be allowed to flow around the filter medium 152 to the nozzle 184 and outlet 182.

In alternative embodiments, as illustrated in FIG. 8, a generally opposite flow path through the filter medium 152 may be defined. For example, a flow path may be defined through the inlet(s) 180 into the interior 172, from the interior 172 through the filter medium 152 into the interior 154, and from the interior 154 to the outlet 182. For example, water may flow from the interior 154 directly into the nozzle 184, and through the nozzle 184 and outlet 182. In these embodiments, the unfiltered portion of the filter includes the portion of the interior 172 surrounding the filter medium 152, and the filtered portion includes the portion within the interior 154.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance, comprising:

a container defining a first storage volume for receipt of ice;

a water tank, the water tank defining a second storage volume for receipt of water;

a pump in fluid communication with the second storage volume for actively flowing water from the water tank;

an ice maker, the ice maker in fluid communication with the pump for receiving water from the pump, wherein the ice maker comprises an auger at least partially surrounded by a casing and a sealed refrigeration system in thermal communication with the casing;

a filter, the filter comprising a filter medium operable to remove contaminants from water flowing through the filter medium, the filter positioned upstream of the ice maker in a flow direction of water from the second storage volume to the ice maker; and a chute extending between the ice maker and the container for directing ice produced by the ice maker towards the first storage volume.

2. The stand-alone ice making appliance of claim 1, wherein the filter is disposed within the second storage volume, and wherein water is flowable from the second storage volume through the filter to the pump.

3. The stand-alone ice making appliance of claim 1, further comprising a reservoir defining a third storage volume, the third storage volume in fluid communication with the pump for receiving water that is actively flowed from the water tank, and wherein the ice maker is in fluid communication with the third storage volume for receiving water from the reservoir.

4. The stand-alone ice making appliance of claim 1, wherein the filter comprises a sidewall extending along a longitudinal axis between a first end wall and a second end wall, and wherein an inlet is defined proximate the first end wall relative to the second end wall along the longitudinal axis and an outlet is defined proximate the second end wall relative to the first end wall along the longitudinal axis.

5. The stand-alone ice making appliance of claim 4, wherein the inlet is defined in the sidewall and contiguous with the first end wall.

6. The stand-alone ice making appliance of claim 4, wherein a nozzle protrudes from the second end wall along the longitudinal axis and defines the outlet.

7. The stand-alone ice making appliance of claim 6, wherein the nozzle is offset along an outer surface of the second end wall from a centroid of the outer surface.

8. The stand-alone ice making appliance of claim 6, wherein the filter is disposed within the second storage volume, and wherein the nozzle extends into a female fitting of the water tank.

9. The stand-alone ice making appliance of claim 4, wherein the filter medium has a hollow cylindrical shape which defines an interior.

10. The stand-alone ice making appliance of claim 9, wherein the filter further comprises a seal ring, and wherein a flow path is defined for water through the inlet and seal ring into the interior and from the interior through the filter medium to the outlet.

11. The stand-alone ice making appliance of claim 1, wherein the filter comprises a sidewall extending along a longitudinal axis between a first end wall and a second end wall, and wherein a plurality of inlets are defined in the sidewall and an outlet is defined proximate the second end wall relative to the first end wall along the longitudinal axis.

12. The stand-alone ice making appliance of claim 11, wherein a flow path is defined for water through the plurality of inlets and through the filter medium to an interior defined by the filter medium, and from the interior to the outlet.

13. The stand-alone ice making appliance of claim 1, wherein the filter is disposed within the second storage volume, and wherein the filter medium forms a partition within the second storage volume.

14. The stand-alone ice making appliance of claim 1, wherein ice within the first storage volume is maintained at a temperature greater than thirty-two degrees Fahrenheit.

15. A stand-alone ice making appliance, comprising:

a removable container defining a first storage volume for receipt of ice;

a water tank, the water tank defining a second storage volume for receipt of water and disposed below the container along a vertical direction;

a pump in fluid communication with the second storage volume for actively flowing water from the water tank;

a reservoir defining a third storage volume, the third storage volume in fluid communication with the pump for receiving water that is actively flowed from the water tank;

an ice maker, the ice maker comprising a sealed refrigeration system;

a chute extending between the ice maker and the container for directing ice produced by the ice maker towards the first storage volume; and a filter disposed within the second storage volume, the filter comprising a filter medium operable to remove contaminants from water flowing through the filter medium, wherein water is flowable from the second storage volume through the filter to the pump, and wherein ice within the first storage volume is maintained at a temperature greater than thirty-two degrees Fahrenheit.

16. The stand-alone ice making appliance of claim 15, wherein the filter comprises a sidewall extending along a longitudinal axis between a first end wall and a second end wall, and wherein an inlet is defined proximate the first end wall relative to the second end wall along the longitudinal axis and an outlet is defined proximate the second end wall relative to the first end wall along the longitudinal axis.

17. The stand-alone ice making appliance of claim 15, wherein the filter comprises a sidewall extending along a longitudinal axis between a first end wall and a second end wall, and wherein a plurality of inlets are defined in the sidewall and an outlet is defined proximate the second end wall relative to the first end wall along the longitudinal axis.

18. The stand-alone ice making appliance of claim 15, wherein the filter medium forms a partition within the second storage volume.

* * * * *